US009829830B2

(12) United States Patent
Sasaki

(10) Patent No.: US 9,829,830 B2
(45) Date of Patent: Nov. 28, 2017

(54) DEVELOPING DEVICE REPLENISHED WITH NEW TWO-COMPONENT DEVELOPER WHILE DISCHARGING SURPLUS DEVELOPER AND IMAGE FORMING APPARATUS

(71) Applicant: KYOCERA Document Solutions Inc., Osaka (JP)

(72) Inventor: Yu Sasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/378,848

(22) Filed: Dec. 14, 2016

(65) Prior Publication Data

US 2017/0219958 A1 Aug. 3, 2017

(30) Foreign Application Priority Data

Feb. 1, 2016 (JP) ..... 2016-017006

(51) Int. Cl.
*G03G 15/08* (2006.01)

(52) U.S. Cl.
CPC ... *G03G 15/0893* (2013.01); *G03G 2215/083* (2013.01); *G03G 2215/0838* (2013.01)

(58) Field of Classification Search
CPC ..... G03G 15/0889; G03G 15/0891; G03G 15/0893; G03G 2215/0822; G03G 2215/083; G03G 2215/0838
USPC ..... 399/254, 256
See application file for complete search history.

(56) References Cited

U.S. PATENT DOCUMENTS

| | | | | |
|---|---|---|---|---|
| 9,405,229 | B1 * | 8/2016 | Nose | G03G 15/0891 |
| 9,658,573 | B2 * | 5/2017 | Saito | G03G 15/0891 |
| 9,658,575 | B2 * | 5/2017 | Sasaki | G03G 15/0893 |
| 2012/0177412 | A1 * | 7/2012 | Watanabe | G03G 15/0189 399/256 |
| 2015/0003876 | A1 | 1/2015 | Iida et al. | 399/254 |

(Continued)

FOREIGN PATENT DOCUMENTS

| | | | |
|---|---|---|---|
| JP | 2008256917 | A * | 10/2008 |
| JP | 2010256701 | A * | 11/2010 |

(Continued)

*Primary Examiner* — Robert Beatty
(74) *Attorney, Agent, or Firm* — Stein IP, LLC

(57) ABSTRACT

A developing device has a developer container, first and second stirring members, and a developer carrying member. The developer container has a plurality of transport chambers including first and second transport chambers, a communication portion through which the first and second transport chambers mutually communicate in opposite end parts thereof in their longitudinal direction, a developer supply port, and a developer discharge port arranged in a downstream-side end part of the second transport chamber. The second stirring member has a second transport blade, a regulating portion formed on the downstream side of the second transport blade, a discharge blade formed on the downstream side of the regulating portion and discharging developer through the developer discharge port, and a disk formed at a position facing the downstream-side communication portion on the upstream side of the regulating portion and radially protruding over the entire circumference of a rotary shaft.

8 Claims, 6 Drawing Sheets

(56) References Cited

U.S. PATENT DOCUMENTS

| | | | | |
|---|---|---|---|---|
| 2015/0139697 | A1* | 5/2015 | Tsukijima | G03G 15/0893 399/254 |
| 2015/0331360 | A1* | 11/2015 | Akedo | G03G 15/0893 399/254 |
| 2016/0209778 | A1* | 7/2016 | Katsumata | G03G 15/0891 |
| 2016/0370734 | A1* | 12/2016 | Suenami | G03G 15/0865 |
| 2017/0060032 | A1* | 3/2017 | Iida | G03G 15/0893 |

FOREIGN PATENT DOCUMENTS

| | | | | |
|---|---|---|---|---|
| JP | 2011048184 | A | * | 3/2011 |
| JP | 2012108236 | A | * | 6/2012 |
| JP | 2015-11158 | A | | 1/2015 |

* cited by examiner

--Related Art--

DEVELOPING DEVICE REPLENISHED WITH NEW TWO-COMPONENT DEVELOPER WHILE DISCHARGING SURPLUS DEVELOPER AND IMAGE FORMING APPARATUS

INCORPORATION BY REFERENCE

This application is based upon and claims the benefit of priority from the corresponding Japanese Patent Application No. 2016-017006 filed on Feb. 1, 2016, the entire contents of which are incorporated herein by reference.

BACKGROUND

The present disclosure relates to a developing device incorporated in an image forming apparatus exploiting electrophotography, such as a copier, a printer, a facsimile machine, or a multifunction peripheral thereof, and to an image forming apparatus incorporating such a developing device. More particularly, the present disclosure relates to a developing device which can be replenished with fresh two-component developer containing toner and carrier and can meanwhile discharge surplus developer, and to an image forming apparatus incorporating such a developing device.

In an image forming apparatus, an electrostatic latent image formed on an image carrying member comprising a photosensitive member or the like is made visible by being developed into a toner image by a developing device. Some such developing devices adopt a two-component developing system that uses two-component developer. In this type of developing device, two-component developer (hereinafter, also referred to simply as developer) containing carrier and toner is stored in a developer container, there is arranged a developing roller which feeds the developer to the image carrying member, and there is arranged a stirring member which transports, while stirring, the developer inside the developer container to feed it to the developing roller.

In the developing device, toner is consumed in developing operation, while carrier is left unconsumed in the developing device. Thus, the carrier stirred together with toner inside the developer container deteriorates as it keeps being stirred repeatedly, gradually diminishing the toner charging performance of the carrier.

As a solution, developing devices have been proposed that supply fresh developer containing carrier into a developer container while discharging surplus developer so as to suppress degradation in charging performance.

For example, a known developing device based on a system in which fresh carrier and toner are supplied into a developer container includes a first transport portion which transports developer inside a developer container, a second transport portion which is arranged on the downstream side of the first transport portion in the transport direction thereof and which is formed by a helical blade spiraling in the opposite direction so as to transport developer in the direction opposite to the first transport portion, a disk portion arranged on the upstream side of the second transport portion in the transport direction thereof, and a third transport portion which is arranged on the upstream side of the disk portion in the transport direction of the second transport portion, for transporting developer into a developer discharge port. In the developing device, the disk portion and the helical blade of the second transport portion are arranged across a gap.

With this configuration, as fresh developer is supplied into the developer container, the developer is, while being stirred, transported to the downstream side of a transport chamber by rotation of the first transport portion. As the reverse helical blade of the second transport portion rotates in the same direction as the first transport portion, a transport force is applied to the developer in the direction opposite to the developer transport direction by the first transport portion. By the transport force in the opposite direction, the developer is blocked, and increases its height; thus surplus developer moves over the second transport portion and the disk portion (regulating portion) into the developer discharge port and is discharged to the outside. Moreover, an end part of the helical blade of the second transport portion and the disk portion are arranged so as not to be joined to each other so as to stabilize the height of the developer inside the developer container.

SUMMARY

According to one aspect of the present disclosure, a developing device includes a developer container, a first stirring member, a second stirring member, and a developer carrying member. The developer container, for storing two-component developer containing carrier and toner, includes a plurality of transport chambers which is arranged side by side and which includes a first transport chamber and a second transport chamber, a communication portion through which the first and second transport chambers communicate with each other in opposite end parts of the first and second transport chambers in their longitudinal direction, a developer supply port through which developer is supplied, and a developer discharge port which is arranged in a downstream-side end part of the second transport chamber and through which surplus developer is discharged. The first stirring member is composed of a rotary shaft and a first transport blade formed on the circumferential surface of the rotary shaft, and stirs and transports developer inside the first transport chamber in the axial direction of the rotary shaft. The second stirring member is composed of a rotary shaft and a second transport blade formed on the circumferential surface of the rotary shaft, and stirs and transports the developer inside the second transport chamber in the direction opposite to the first stirring member. The developer carrying member is rotatably supported on the developer container and carries on its surface the developer inside the second transport chamber. The second transport blade includes a regulating portion, a discharge blade, and a disk. The regulating portion is formed next to, on the downstream side of, the second transport blade in the transport direction of the developer inside the second transport chamber, and is formed by a transport blade that transports developer in the direction opposite to the second transport blade. The discharge blade is formed next to, on the downstream side of, the regulating portion in the transport direction of the developer inside the second transport chamber, and transports the developer in the same direction as the second transport blade to discharge the developer through the developer discharge port. The disk is formed at a position facing the communication portion on the downstream side of the second transport chamber, on the upstream side of the regulating portion in the transport direction of the developer inside the second transport chamber, and protrudes in the radial direction over the entire circumference of the rotary shaft.

Further features and advantages of the present disclosure will become apparent from the description of embodiments given below.

DETAILED DESCRIPTION

Figure 1:
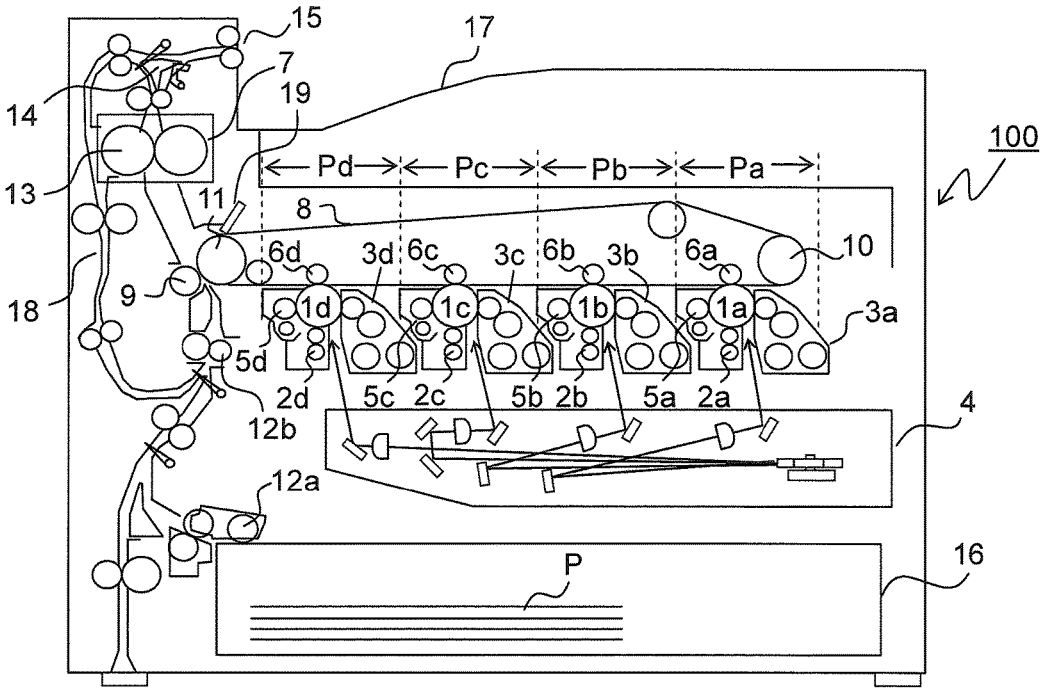
FIG. 1 is a schematic sectional view of a color printer 100 incorporating developing devices 3*a* to 3*d* according to the present disclosure.

Hereinafter, an embodiment of the present disclosure will be described with reference to the accompanying drawings. FIG. 1 is a schematic sectional view of an image forming apparatus incorporating a developing device according to the present disclosure, here showing a tandem-type color printer. Inside the main body of the color printer 100, four image forming units Pa, Pb, Pc, and Pd are arranged in this order from the upstream side in the transport direction (the right side in FIG. 1). These image forming units Pa to Pd are provided to correspond to images of four different colors (cyan, magenta, yellow, and black) respectively, and sequentially form cyan, magenta, yellow, and black images respectively, each through the processes of electrostatic charging, exposure to light, image development, and image transfer.

In these image forming units Pa to Pd, there are respectively arranged photosensitive drums 1*a*, 1*b*, 1*c*, and 1*d* that carry visible images (toner images) of the different colors. Moreover, an intermediate transfer belt 8 that rotates in the clockwise direction in FIG. 1 by being driven by a driving means (unillustrated) is arranged next to the image forming units Pa to Pd.

Transfer sheets P to which toner images are to be transferred are stored in a sheet cassette 16 in a lower part of the main body of the color printer 100, and are transported via a sheet feeding roller 12*a* and a registration roller pair 12*b* to a secondary transfer roller 9. On the downstream side of the secondary transfer roller 9, a blade-shaped belt cleaner 19 is arranged for removing toner left unused on the surface of the intermediate transfer belt 8.

When an instruction to start image formation is fed in from a host device such as a personal computer, first, by the charging devices 2*a* to 2*d*, the surfaces of the photosensitive drums 1*a* to 1*d* are electrostatically charged uniformly. Then, by an exposure unit 4, the surfaces of the photosensitive drums 1*a* to 1*d* are irradiated with light, and thereby electrostatic latent images based on an image signal are formed on the photosensitive drums 1*a* to 1*d* respectively. The developing devices 3*a* to 3*d* are charged with predetermined amounts of toner of different colors, namely cyan, magenta, yellow, and black respectively, by a supplying device (unillustrated). The toner is fed from the developing devices 3*a* to 3*d* onto the photosensitive drums 1*a* to 1*d*, and electrostatically attaches to them, thereby forming toner images based on the electrostatic latent images formed by exposure to light from the exposure unit 4.

Then, after an electric field has been applied to the intermediate transfer belt 8 with a predetermined transfer voltage, by primary transfer rollers 6*a* to 6*d*, the cyan, magenta, yellow, and black toner images on the photosensitive drums 1*a* to 1*d* are transferred to the intermediate transfer belt 8. Thereafter, toner left unused on the surfaces of the photosensitive drums 1*a* to 1*d* is removed by cleaning portions 5*a* to 5*d*.

The intermediate transfer belt 8 is wound around a plurality of tension rollers including a transport roller 10 on the upstream side and a driving roller 11 on the downstream side. As the driving roller 11 rotates by being driven by a driving motor (unillustrated), the intermediate transfer belt 8 rotates in the clockwise direction; meanwhile, a transport sheet P is transported from the registration roller pair 12*b*, with predetermined timing, to the secondary transfer roller 9 arranged next to the intermediate transfer belt 8 so that a full-color image is transferred to the transport sheet P. The transfer sheet P having the toner images transferred to it is transported to the fixing portion 7.

The transfer sheet P transported to the fixing portion 7 is then heated and pressed there by a fixing roller pair 13 so that the toner images are fixed to the surface of the transport sheet P to form the predetermined full-color image. The transfer sheet P having the full-color image formed on it is discharged as it is (or after being distributed by a branching portion 14 into a reverse transport passage 18 and having images formed on both sides of it) onto a discharge tray 17 by a discharge roller pair 15.

Figure 2:
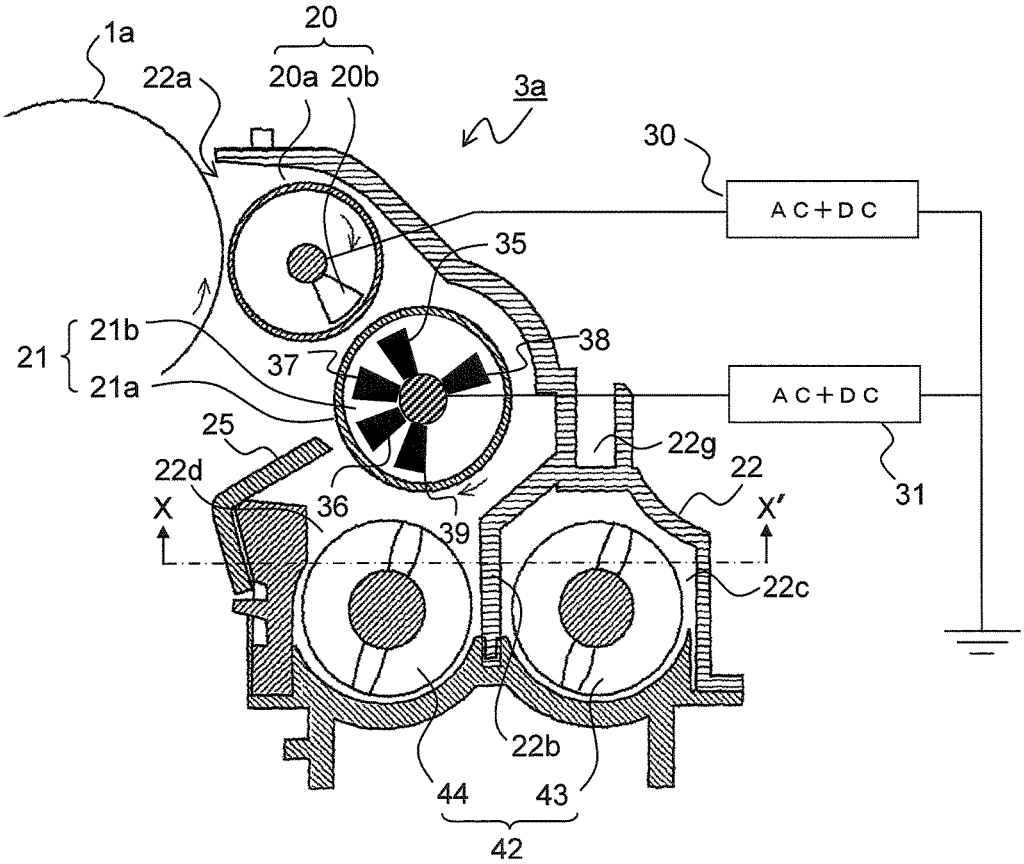
FIG. 2 is a side sectional view of the developing device 3*a* according to one embodiment of the present disclosure.

FIG. 2 is a side sectional view showing a structure of the developing device 3*a* incorporated in the color printer 100. Although the following description deals with the developing device 3*a* arranged in the image forming unit Pa in FIG. 1, the developing devices 3*b* to 3*d* arranged in the image forming units Pb to Pd have basically the same structure, and thus no overlapping description will be repeated.

As shown in FIG. 2, the developing device 3*a* includes a developer container 22 for storing two-component developer. The developer container 22 has an opening 22*a* formed in it through which a developing roller 20 is exposed toward the photosensitive drum, and is divided into first and second transport chambers 22*c* and 22*d* by a partition wall 22*b*. In the first and second transport chambers 22*c* and 22*d*, there is rotatably arranged a stirring member 42, composed of a first stirring screw 43 and a second stirring screw 44, for mixing and stirring toner (positively charged toner) fed from an unillustrated toner container with carrier and for electrostatically charging the toner.

Then, by the first stirring screw 43 and the second stirring screw 44, developer is transported, while being stirred, in the axial direction, to circulate between the first and second transport chambers 22*c* and 22*d* via communication portions 22*e* and 22*f* (see FIG. 4) formed at opposite ends of the partition wall 22*b*. In the example shown in FIG. 2, the developer container 22 extends obliquely to the upper left side; in the developer container 22, a magnetic roller 21 is arranged over the second stirring screw 44, and a developing roller 20 is arranged opposite the magnetic roller 21, obliquely on the upper left of it. Moreover, the developing roller 20 is arranged opposite the photosensitive drum 1*a*, beside the opening 22*a* in the developer container 22 (on the left side in FIG. 2), and the magnetic roller 21 and the developing roller 20 rotate in the clockwise direction in FIG. 2.

In the developer container 22, a toner concentration sensor (unillustrated) is arranged to face the first stirring screw 43. According to the toner concentration detected by the toner density sensor, toner is supplied from the supplying device (unillustrated) through a toner supply port 22*g* into the developer container 22.

The magnetic roller 21 is composed of a non-magnetic rotary sleeve 21*a* and a fixed magnet member 21*b* housed in the rotary sleeve 21*a* and having a plurality of magnetic poles. In this embodiment, the magnetic poles of the fixed magnet member 21*b* include five poles, namely a main pole 35, a regulating pole (magnetic pole for trimming) 36, a transporting pole 37, a peeling pole 38, and a scooping pole 39. A predetermined gap is secured between the magnetic roller 21 and the developing roller 20 at their facing position (opposing position) at which they face each other.

To the developer container 22, a trimming blade 25 is fitted along the longitudinal direction of the magnetic roller 21 (the direction perpendicular to the plane of FIG. 2). The trimming blade 25 is positioned, in the rotation direction of the magnetic roller 21 (the clockwise direction in FIG. 2), on the upstream side of the opposing position of the developing roller 20 and the magnetic roller 21. Moreover, a small gap is formed between a tip end part of the trimming blade 25 and the surface of the magnetic roller 21.

The developing roller 20 is composed of a non-magnetic developing sleeve 20*a* and a developing roller-side magnetic pole 20*b* fixed in the developing sleeve 20*a*. The developing roller-side magnetic pole 20*b* has the opposite polarity to that of the magnetic pole (main pole) 35 of the fixed magnet member 21*b*, the developing roller-side magnetic pole 20*b* facing the magnetic pole 35.

To the developing roller 20, a first bias circuit 30 is connected for applying to it a DC bias (hereinafter referred to as Vslv(DC)) and an AC bias (hereinafter referred to as Vslv(AC)). To the magnetic roller 21, a second bias circuit 31 is connected for applying to it a DC bias (hereinafter referred to as Vmag(DC)) and an AC bias (hereinafter Vmag(AC)). The first bias circuit 30 and the second bias circuit 31 are connected to a common ground.

As described above, by the first stirring screw 43 and the second stirring screw 44, developer is transported, while being stirred, to circulate in the developer container 22 while toner is electrostatically charged; by the second stirring screw 44, the developer is transported to the magnetic roller 21. Since the regulating pole 36 of the fixed magnet member 21*b* faces the trimming blade 25, by use of a non-magnetic member or a magnetic member having the polarity opposite to the regulating pole 36 as the trimming blade 25, a magnetic field is produced in the gap between the tip end part of the trimming blade 25 and the rotary sleeve 21*a* in a direction in which these attract each other.

With this magnetic field, a magnetic brush is formed between the trimming blade 25 and the rotary sleeve 21*a*. The magnetic brush on the magnetic roller 21 has its layer thickness regulated by the trimming blade 25, and then moves to a position facing the developing roller 20; there, to the magnetic brush, an magnetic field is applied in a direction in which the main pole 35 of the fixed magnet member 21*b* and the developing roller-side magnetic pole 20*b* attract each other, and thus the magnetic brush makes contact with the surface of the developing roller 20. Then, by this magnetic field and by the potential difference ΔV between the Vmag(DC) applied to the magnetic roller 21 and the Vslv(DC) applied to the developing roller 20, a thin layer of toner is formed on the developing roller 20.

The thickness of the toner layer on the developing roller 20 varies according to the resistance of developer, the difference in rotation speed between the magnetic roller 21 and the developing roller 20, etc., but can be controlled by controlling the potential difference ΔV. Increasing the potential difference ΔV makes the layer of toner on the developing roller 20 thicker, and decreasing the potential difference ΔV makes the layer of toner thinner. A proper range of the potential difference ΔV during development is from 100V to 350V.

Figure 3A:
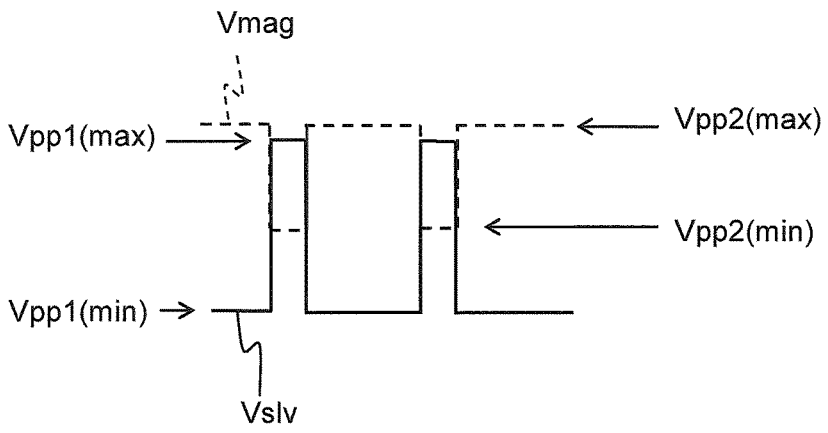
FIG. 3A is a diagram showing an example of a waveform of a bias applied to a developing roller 20 and a magnetic roller 21, showing a composite waveform Vslv applied to a developing roller 20.
Figure 3B:
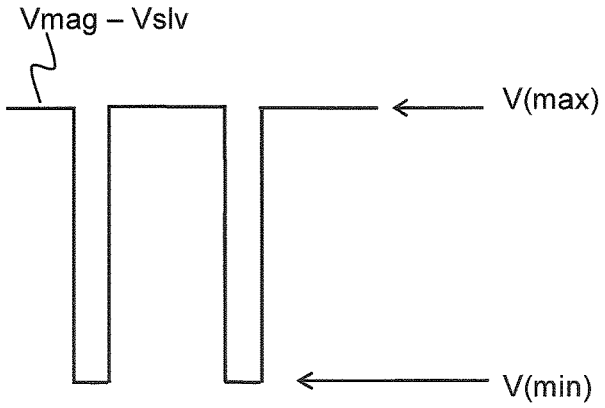
FIG. 3B is a diagram showing an example of a waveform of a bias applied to the developing roller 20 and to the magnetic roller 21, showing a composite waveform Vmag-Vslv applied between the magnetic roller 21 and the developing roller 20.

FIGS. 3A and 3B are diagrams showing an example of the waveforms of the biases applied to the developing roller 20 and to the magnetic roller 21. As shown in FIG. 3A, to the developing roller 20, a composite waveform Vslv (solid line) is applied by the first bias circuit 30. The composite waveform Vslv has rectangular waves Vslv(AC) with a peak-to-peak value Vpp1 superimposed on a DC voltage Vslv(DC). To the magnetic roller 21, a composite waveform Vmag (broken-line) is applied by the second bias circuit 31. The composite waveform Vmag has rectangular waves Vmag(AC) with a peak-to-peak value Vpp2 and with the opposite phase to that of the Vslv(AC) superimposed on a DC voltage Vmag(DC).

Thus, the voltage applied between the magnetic roller 21 and the developing roller 20 (hereinafter referred to as across the MS interval) has a composite waveform Vmag-Vslv having peak voltages Vpp(max) and Vpp(min) as shown in FIG. 3B. Here, Vmag(AC) is set so as to have a duty ratio larger than that of Vslv(AC). The AC bias that is actually applied is not perfectly rectangular waves as shown in FIGS. 3A and 3B, but has a partly distorted waveform.

The thin layer of toner formed on the developing roller 20 by the magnetic brush is transported, by the rotation of the developing roller 20, to a part at which the photosensitive drum 1*a* and the developing roller 20 face each other. Since Vslv(DC) and Vslv(AC) are applied to the developing roller 20, due to the potential difference between the developing roller 20 and the photosensitive drum 1*a*, toner flies to the photosensitive drum 1*a* so that an electrostatic latent image on it is developed.

As the rotary sleeve 21*a* rotates farther in the clockwise direction, by a magnetic field produced in the horizontal direction (the roller circumferential direction), this time, by the peeling pole 38 which is arranged next to the main pole 35 and which has the opposite polarity to the main pole 35, the magnetic brush is separated from the surface of the developing roller 20, and toner left unused during development is collected from the developing roller 20 onto the rotary sleeve 21*a*. As the rotary sleeve 21*a* rotates farther, a magnetic field is applied in a direction in which, of the fixed magnet member 21*b*, the peeling pole 38 and the scooping pole 39, which has the same polarity as the peeling pole 38, repel each other, and thus toner leaves the rotary sleeve 21*a* within the developer container 22. Then, after being stirred and transported by the second stirring screw 44, the toner is again, as two-component developer which has a proper toner concentration and which is electrostatically charged uniformly, formed by the scooping pole 39 into a magnetic brush on the rotary sleeve 21*a*, and is transported to the trimming blade 25.

Figure 4:
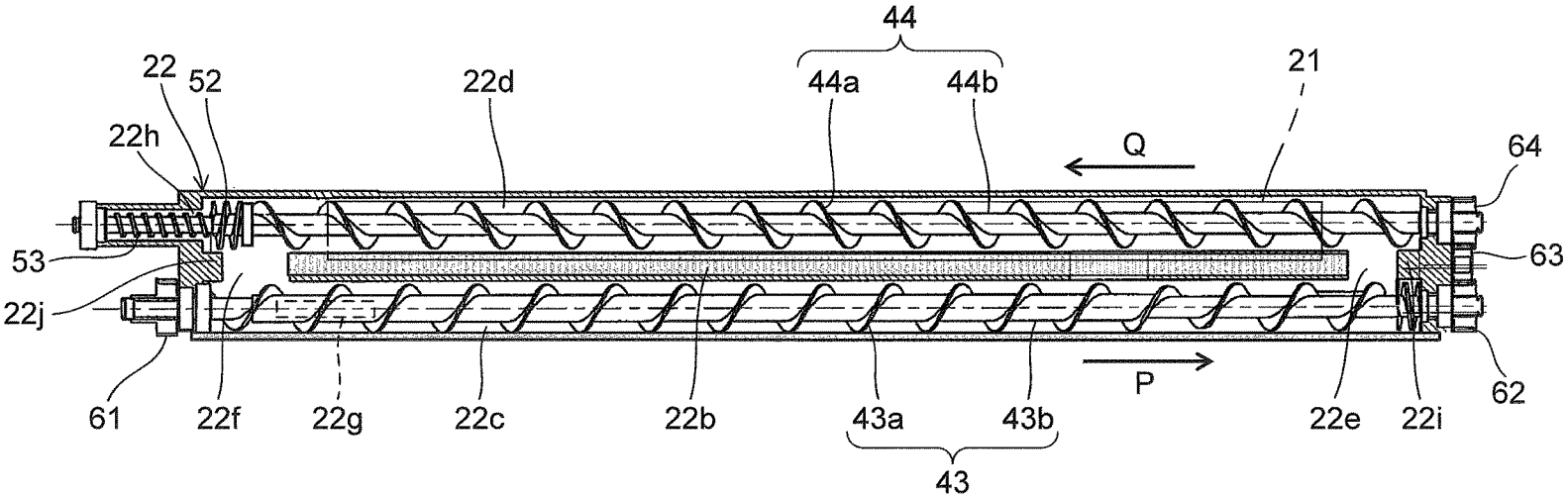
FIG. 4 is a sectional plan view of a stirring portion in the developing device 3*a* according to the embodiment.

Next, the structure of a stirring portion in the developing device 3*a* will be described in detail. FIG. 4 is a sectional plan view (as seen from the direction indicated by arrows X and X' in FIG. 2) of the stirring portion in the developing device 3*a*.

In the developer container 22, as described previously, there are formed the first transport chamber 22*c*, the second transport chamber 22*d*, the partition wall 22*b*, the upstream-side communication portion 22*e*, and the downstream-side communication portion 22*f*; there are further formed a developer supply port 22*g*, a developer discharge port 22*h*, an upstream-side wall portion 22*i*, and a downstream-side wall portion 22*j*. With respect to the first transport chamber 22*c*, the left side in FIG. 4 is the upstream side and the right side in FIG. 4 is the downstream side; with respect to the second transport chamber 22*d*, the right side in FIG. 4 is the upstream side and the left side in FIG. 4 is the downstream side. Thus, the communication portions and the side wall portions are distinguished between the upstream-side and downstream-side ones relative to the second transport chamber 22*d*.

The partition wall 22*b* extends in the longitudinal direction of the developer container 22 to separate the first transport chamber 22*c* and the second transport chamber 22*d* such that these lie side by side. A right end part of the partition wall 22*b* in the longitudinal direction forms the upstream-side communication portion 22*e* together with an inner wall part of the upstream-side wall portion 22*i*. On the other hand, a left end part of the partition wall 22*b* in the longitudinal direction forms the downstream-side communication portion 22*f* together with an inner wall part of the downstream-side wall portion 22*j*. Thus, developer can circulate through the first transport chamber 22*c*, the upstream-side communication portion 22*e*, the second transport chamber 22*d*, and the downstream-side communication portion 22*f*.

The developer supply port 22*g* is an opening through which fresh toner and carrier are supplied from a developer supply container (unillustrated) provided over the developer container 22 into the developer container 22. The developer supply port 22*g* is arranged on the upstream side (the left side in FIG. 4) of the first transport chamber 22*c*.

The developer discharge port 22*h* is an opening through which surplus developer in the first and second transport chambers 22*c* and 22*d* resulting from supply of fresh developer is discharged. The developer discharge port 22*h* is arranged continuous with the second transport chamber 22*d* in the longitudinal direction, on the downstream side of the second transport chamber 22*d*.

In the first transport chamber 22*c*, the first stirring screw 43 is arranged; in the second transport chamber 22*d*, the second stirring screw 44 is arranged.

The first stirring screw 43 has a rotary shaft 43*b* and a first helical blade 43*a* provided integrally with the rotary shaft 43*b* and formed in a helical shape with a predetermined pitch in the axial direction of the rotary shaft 43*b*. The first helical blade 43*a* extends up to opposite end parts of the first transport chamber 22*c* in the longitudinal direction, and is arranged to face the upstream-side and downstream-side communication portions 22*e* and 22*f*. The rotary shaft 43*b* is rotatably supported on the upstream-side wall portion 22*i* and the downstream-side wall portion 22*j* of the developer container 22.

The second stirring screw 44 has a rotary shaft 44*b* and a second helical blade 44*a* provided integrally with the rotary shaft 44*b* and formed in a helical shape spiraling in the opposite direction (in the opposite phase) to the first helical blade 43*a* with the same pitch as the first helical blade 43*a* in the axial direction of the rotary shaft 44*b*. The second helical blade 44*a* has a length larger than that of the magnetic roller 21 in the axial direction, and is arranged so as to extend up to a position facing the upstream-side communication portion 22*e*. The rotary shaft 44*b* is arranged parallel to the rotary shaft 43*b* and is rotatably supported on the upstream-side wall portion 22*i* and the downstream-side wall portion 22*j* of the developer container 22.

On the rotary shaft 44*b*, a regulating portion 52 and a discharge blade 53 are integrally arranged together with the second helical blade 44*a*.

The regulating portion 52 makes it possible to block the developer transported to the downstream side inside the second transport chamber 22*d* and to transport the developer to the developer discharge port 22*h* when the amount of developer exceeds a predetermined amount. The regulating portion 52 comprises a helical blade arranged on the rotary shaft 44*b* and is formed in a helical shape spiraling in the opposite direction (in the opposite phase) to the second helical blade 44*a*. The regulating portion 52 is configured to have substantially the same outer diameter as, but a smaller pitch than, the second helical blade 44*a*. Moreover, the regulating portion 52 forms a predetermined gap between an inner wall part of the developer container 22, such as the downstream-side wall portion 22*j*, and an outer circumferential part of the regulating portion 52. Through this gap, surplus developer is transported into the developer discharge port 22*h*.

The rotary shaft 44*b* extends into the developer discharge port 22*h*. On the rotary shaft 44*b* in the developer discharge port 22*h*, the discharge blade 53 is arranged. The discharge blade 53 comprises a helical blade spiraling in the same direction as the second helical blade 44*a*, but has a smaller pitch and a smaller blade circumference than the second helical blade 44*a*. Thus, as the rotary shaft 44*b* rotates, the discharge blade 53 also rotates so that the surplus developer transported into the developer discharge port 22*h* over the regulating portion 52 is transported to the left side in FIG. 4 to be discharged out of the developer container 22. The discharge blade 53, the regulating portion 52, and the second helical blade 44*a* are formed integrally with the rotary shaft 44*b* out of synthetic resin.

On an outer wall of the developer container 22, gears 61 to 64 are arranged. The gears 61 and 62 are fixed on the rotary shaft 43*b*, and the gear 64 is fixed on the rotary shaft 44*b*. The gear 63 is rotatably held on the developer container 22 to mesh with the gears 62 and 64.

During development, during which period no fresh developer is supplied, as the gear 61 rotates by the action of a driving source such as a motor, the first helical blade 43*a* rotates together with the rotary shaft 43*b*. By the first helical blade 43*a*, the developer in the first transport chamber 22*c* is transported in the main transport direction (the direction indicated by arrow P), and the developer is then transported through the upstream-side communication portion 22*e* into the second transport chamber 22*d*. Moreover, as the second helical blade 44*a* rotates together with the rotary shaft 44*b* which follows the rotary shaft 43*b*, by the second helical blade 44*a*, the developer in the second transport chamber 22*d* is transported in the main transport direction (the direction indicated by arrow Q). Thus, the developer is, while greatly varying its height, transported from the first transport chamber 22*c* through the upstream-side communication portion 22*e* into the second transport chamber 22*d*, and the developer is then, without going over the regulating portion 52, transported through the downstream-side communication portion 22*f* to the first transport chamber 22*c*.

In this way, developer, while being stirred, circulates through the first transport chamber 22*c*, the upstream-side communication portion 22*e*, the second transport chamber 22*d*, and the downstream-side communication portion 22*f*, and the stirred developer is fed to the magnetic roller 21.

Next, how developer is supplied through the developer supply port 22*g* will be described. As toner is consumed in development, developer containing carrier is supplied through the developer supply port 22*g* into the first transport chamber 22*c*.

The supplied developer is, as during development, transported in the direction indicated by arrow P inside the first transport chamber 22*c* by the first helical blade 43*a*, and the developer is then transported through the upstream-side communication portion 22*e* into the second transport chamber 22*d*. Moreover, by the second helical blade 44*a*, the developer in the second transport chamber 22*d* is transported in the main transport direction (the direction indicated by arrow Q). As the regulating portion 52 rotates together with the rotary shaft 44*b*, a transporting force in the direction opposite to the main transport direction (the opposite transport direction) is applied to the developer by the regulating portion 52. The developer increases its height by being blocked by the regulating portion 52, and the surplus developer (the same amount as the amount of developer supplied through the developer supply port 22*g*) goes over the regulating portion 52 and is discharged via the developer discharge port 22*h* out of the developer container 22.

Figure 5:
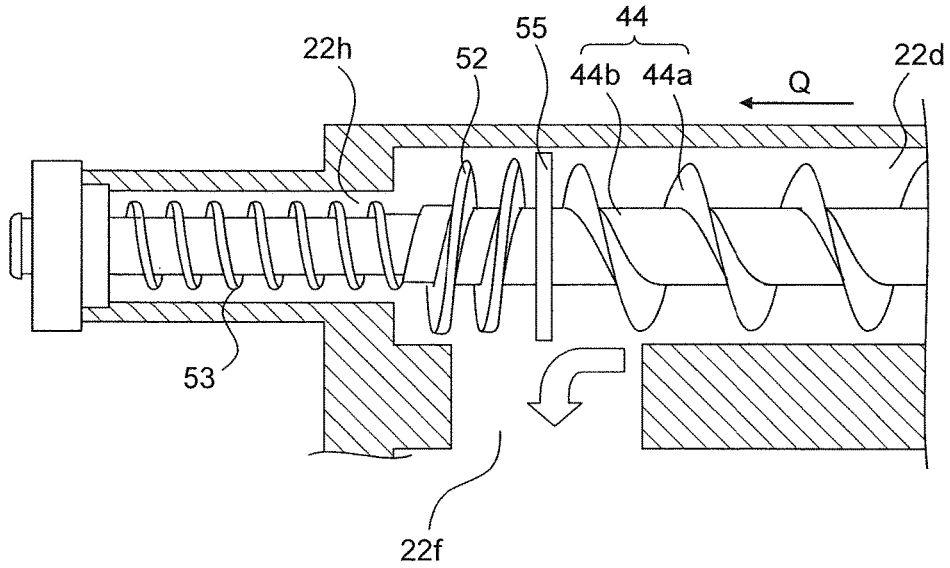
FIG. 5 is an enlarged view around the developer discharge port 22*h* in FIG. 4.

FIG. 5 is an enlarged view around the developer discharge port 22*h* in FIG. 4. As shown in FIG. 5, on the second stirring screw 44, a disk 55 is arranged between the second helical blade 44*a* and the regulating portion 52. The disk 55 is, together with the second helical blade 44*a*, the regulating portion 52, and the discharge blade 53, formed integrally with the rotary shaft 44*b* out of synthetic resin.

With the configuration according to the present disclosure, the transporting force with which developer is transported in the main transport direction (the direction indicated by arrow Q) by the second helical blade 44*a* is temporarily blocked and weakened by the disk 55. Then, a transporting force is applied to the developer in the opposite direction by the regulating portion 52, and the developer is pushed back in the direction opposite to the main transport direction. That is, the disk 55 serves as a buffer that reduces the transporting force (pressure) with which the developer moves from the second transport chamber 22*d* to the regulating portion 52. The higher the rotation rate of the second stirring screw 44, the greater the buffer effect (speed reducing effect) of the disk 55, and this makes the speed and the amount of the developer that passes over the regulating portion 52 less dependent on the rotation rate (developer transporting speed) of the second stirring screw 44.

Arranging the disk 55 at a position overlapping the downstream-side communication portion 22*f* permits the disk 55 to serve to adjust the amount of the developer that moves toward the first stirring screw 43 and the amount of the developer that passes over the regulating portion 52; these can be adjusted according to the position where the disk 55 is arranged and the size (diameter and thickness) of the disk 55. That is, it is possible to adjust the amount and speed of the developer passing over the regulating portion 52 according to the amount and position of stagnating developer, and thus to adjust the amount of the developer discharged via the developer discharge port 22*h* by the discharge blade 53. Letting developer stagnate permits the kinetic energy of the developer passing over the regulating portion 52 to be kept constant; this provides higher robustness even against the variation of the fluidity of the developer caused by variation of the toner concentration (T/C) in the developer or of the use environment, such as in temperature and humidity.

When the outer diameter of the disk 55 is smaller than the outer diameter of the oppositely spiraling helical blade which forms the regulating portion 52, the buffer effect (speed reducing effect) of the disk 55 is insufficient; this inconveniently allows the developer transported by the second helical blade 44*a* to easily move to the regulating portion 52. Thus, the outer diameter of the disk 55 is preferably equal to or larger than the outer diameter of the oppositely spiraling helical blade which forms the regulating portion 52.

When developer is supplied through the developer supply port 22*g* and the height of the developer inside the developer container 22 increases, the pressure is reduced by the disk 55, and the developer staying in the vicinity of the regulating portion 52 moves over the regulating portion 52 to the discharge blade 53 (the developer discharge port 22*h*) so that surplus developer is discharged through the developer discharge port 22*h*.

As described above, with the disk 55, it is possible to block the developer moving from the second transport chamber 22*d* to the regulating portion 52, and thereby to reduce the transporting force of the developer so as to make the developer stay in the vicinity of the regulating portion 52. As a result, it is possible to adjust the amount and the speed of the developer that moves from the regulating portion 52 to the developer discharge port 22*h*, and this stabilizes the amount of the developer discharged through the developer discharge port 22*h*. Thus, even when the fluidity and the transport speed of the developer inside the second transport chamber 22*d* vary, the stable developer amount inside the developer container 22 can be kept substantially constant.

By incorporating developing devices 3*a* to 3*d* according to the present disclosure in a plurality of types of image forming apparatuses 100 having different process speeds, it is possible to eliminate the need to change the design and specifications of the developing devices 3*a* to 3*d* according to the different process speeds.

In an image forming apparatus whose driving speed can be switched between two levels according to the thickness and kind of the recording medium that is transported, for example, when plain paper is used as the recording medium, image formation is performed at an ordinary driving speed (hereinafter referred to as a full speed mode); when thick paper is used as the recording medium, image formation is performed at a speed lower than the ordinary speed (hereinafter referred to as a reduced-speed mode) so as to secure a sufficient fixing time with a view to improving image quality. In such an image forming apparatus, switching from the full speed mode to the reduced-speed mode causes a sharp change in the transport speed of developer inside the developer container 22. In such a case, by incorporating the developing devices 3*a* to 3*d* according to the present disclosure, it is possible to keep the stable developer amount in the developer container 22 substantially constant in both of the full speed mode and the reduced-speed mode.

Figure 6:
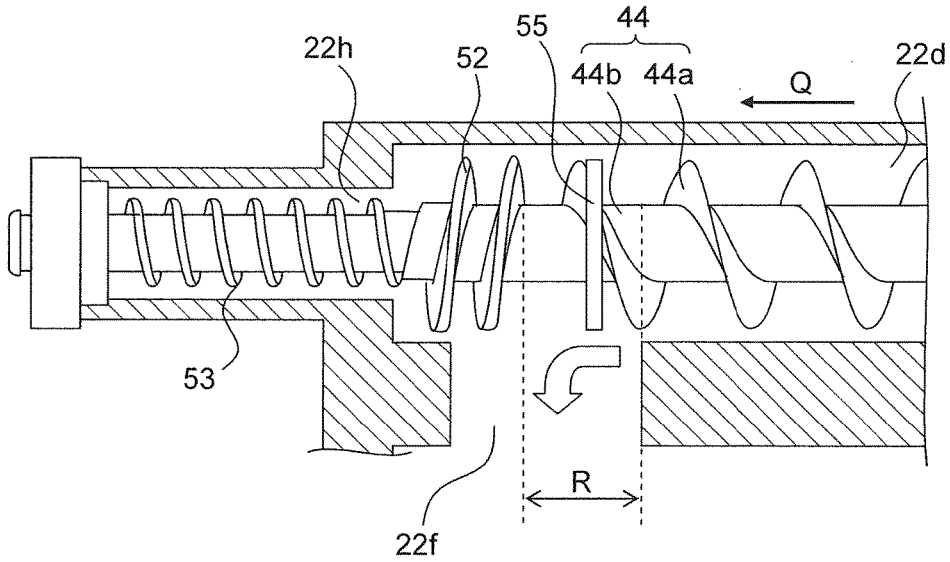
FIG. 6 is an enlarged view around the developer discharge port 22*h* in FIG. 4, showing a modified example in which a disk 55 is arranged at a position overlapping a second transport blade 44*a;*

Although in this embodiment, the disk 55 is arranged between the second helical blade 44*a* and the regulating portion 52, this is in no way meant to limit the arrangement of the disk 55; the disk 55 may be arranged, for example, as shown in FIG. 6, at a position overlapping the second helical blade 44*a*. That is, the disk 55 may be formed at any position in a region (the region R in FIG. 6) facing the downstream-side communication portion 22*f* on the upstream side of the regulating portion 52 in the transport direction of the developer inside the second transport chamber 22*d*.

Here, the closer the disk 55 is arranged to the regulating portion 52, the weaker the buffer effect of the disk 55 is, and the larger the amount of developer that moves toward the regulating portion 52. On the other hand, the closer the disk 55 is arranged to the second helical blade 44*a* (the farther away from the regulating portion 52), the greater the buffer effect of the disk 55 is, and the smaller the amount of developer that moves toward the regulating portion 52. That is, by varying the forming position and outer diameter (the clearance from the inner wall surface of the second transport chamber 22*d*) of the disk 55, it is possible to adjust the stable developer amount inside the developer container 22.

The embodiment described above is in no way meant to limit the present disclosure, which thus allows for many modifications and variations within the spirit of the present disclosure. For example, the present disclosure is applicable, not only to a developing device provided with a magnetic roller 21 and a developing roller 20 as shown in FIG. 2, but also to various developing devices that use two-component developer that contains toner and carrier. For example, although the above-described embodiment deals with a two-axis transport type developing device provided with a first transport chamber 22*c* and a second transport chamber 22*d* arranged side by side as developer circulating passages in a developer container 22, the present disclosure is applicable also to a three-axis transport type developing device provided additionally with a collecting transport chamber in which developer removed from the magnetic roller 21 is collected to be fed back to the second transport chamber 22*d*.

In the above-described embodiment, use is made of the first transporting screw 43 composed of the first helical blade 43*a* continuously arranged on the circumferential surface of the rotary shaft 43*b* and the second transporting screw 44 composed of the second helical blade 44*a* continuously arranged on the circumferential surface of the rotary shaft 44*b*; however, the transport blade that transports developer is not limited to a helical blade; instead, use may also be made of, for example, a stirring/transporting member composed of a plurality of semicircular disks (circular disks divided in halves) alternatively arranged with a predetermined inclination angle on the circumferential surfaces of the rotary shafts 43*b* and 44*b*.

Moreover, the present disclosure is applicable, not only to tandem-type color printers like the one shown in FIG. 1, but also to various image forming apparatuses adopting a two-component developing system, such as digital and analog monochrome copiers, monochrome printers, color copiers, facsimile machines, etc. Below, by way of a practical example, the effects of the present disclosure will be described more specifically.

PRACTICAL EXAMPLE

With a color printer 100 as shown in FIG. 1, how the amount of developer in the developing devices 3*a* to 3*d* varies as the transport speed of developer, the toner concentration in developer, and the absolute humidity are varied was examined. The experiment was performed with respect to the image forming unit Pa for cyan that included the photosensitive drum 1*a* and the developing device 3*a*.

Figure 7:
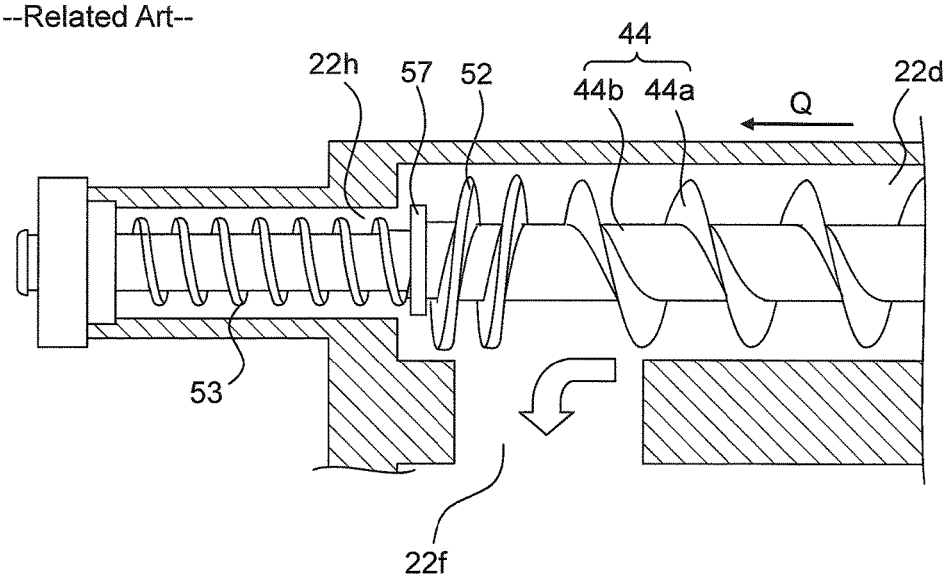
FIG. 7 is an enlarged view around a developer discharge port 22*h* in a developing device 3*a* according to Comparative Example.

In the experiment, a developing device 3*a* as shown in FIG. 5 in which a disk 55 was arranged between the second helical blade 44*a* and the regulating portion 52 of the second transporting screw 44 was taken as Practical Example of the present disclosure. On the other hand, a developing device 3*a* as shown in FIG. 7 in which a disk 57 was arranged between the regulating portion 52 and the discharge blade 53 was taken as Comparative Example.

The second helical blade 44*a* of the second stirring screw 44 used in Practical Example and Comparative Example was a helical blade with an outer diameter of 17 mm, a pitch of 30 mm, and a gap (clearance) of 1.5 mm from the second transport chamber 22*d*. The regulating portion 52 was composed of two turns of helical blades spiraling in opposite directions (opposite phases) with an outer diameter of 12 mm and a pitch of 5 mm, and had a gap of 1.5 mm from the second transport chamber 22*d*. The discharge blade 53 was a helical blade with an outer diameter of 8 mm and a pitch of 5 mm, and had a gap of 1 mm from the developer discharge port 22*h*.

The disk 55 used in Practical Example had an outer diameter of 16 mm and a gap of 2.0 mm from the second transport chamber 22*d*. The disk 57 used in Comparative Example had an outer diameter of 12 mm and a gap of 1.5 mm from the second transport chamber 22*d*.

The developer containers 22 of the developing devices 3*a* according to Practical Example and Comparative Example were each charged with 350 g of developer containing positively charged toner having an average particle diameter of 6.7 μm and ferrite carrier. The rotation speed of the first stirring screws 43 was fixed at 300 rpm while the rotation speed of the second stirring screws 44 was varied. The developer was stirred and transported inside each of those developer containers 22, and when the discharge of the developer through the developer discharge ports 22*h* ceased, the amounts (stable volumes) of developer that were present in the developer containers 22 were measured.

The amounts of developer were measured as follows. The developing devices 3*a* according to Practical Example and Comparative Example were incorporated in testing devices. In a normal-temperature and normal-humidity environment (25° C., 50%), while the rotation speed of the second stirring screws 44 (the stirring speed inside the second transport chambers 22*d*) and the toner concentration (T/C) were varied, the developer was stirred. Then, the weights were measured with the developing devices 3*a* removed. The amounts of developer were calculated by subtracting the weights of the empty developing devices 3*a* without developer from the measured weights of the developing devices 3*a*. The stable volumes were calculated by dividing the calculated amounts of developer by bulk densities. The stirring speed was varied among four levels: 150 rpm, 240 rpm, 330 rpm, and 420 rpm. The toner concentration was varied among three levels: 4%, 8%, and 12%.

Figure 8:
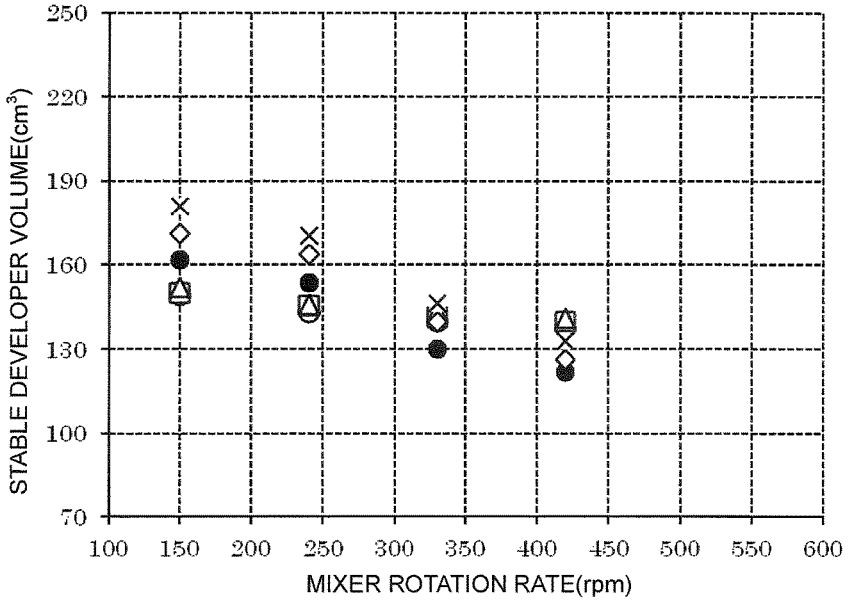
FIG. 8 is a diagram showing variations in the amounts of developer in the developing device 3*a* observed when the transport speed of developer, the toner concentration in developer, the absolute humidity were varied in a developing device 3*a* (Practical Example) in which a disk 55 was arranged between a second helical blade 44*a* and a regulating portion 52 and in a developing device 3*a* (Comparative Example) in which a disk 57 was arranged between a regulating portion 52 and a discharge blade 53.

With different toner concentrations, developer has different loose bulk densities; thus the amounts of developer were compared with one another not by weight but by volume. FIG. 8 shows the results. In FIG. 8, with respect to the developing device 3*a* according to Practical Example, the stable volumes obtained when the toner concentration was 4%, 8%, and 12% are represented by data series indicated by hollow circular, hollow square, and hollow triangular symbols respectively. On the other hand, with respect to the developing device 3*a* according to Comparative Example, the stable volumes obtained when the toner concentration was 4%, 8%, and 12% are represented by data series indicated by solid circular, hollow rhombic, and cross-shaped symbols respectively.

FIG. 8 reveals the following. The developing device 3*a* according to Practical Example exhibited a smaller variation in the stable volume of the developer due to variations in the stirring speed and the toner concentration than in the developing device 3*a* according to Comparative Example. The reason is considered to be as follows. In the developing devices 3*a* according to Practical Example, in which the disk 55 was provided between the second helical blade 44*a* and the regulating portion 52, the effect (buffer effect) to make developer stay by reducing the transporting speed of the developer that passes over the regulating portion 52 was so strong that, even when the stirring speed was varied or when the fluidity of the developer was varied due to variation in the toner concentration, an effect to keep the height of the developer constant was obtained.

The above results confirm the following. With the developing device 3*a* according to Practical Example, in which the disk 55 is arranged between the second helical blade 44*a* and the regulating portion 52, it is possible to suppress variations in the stable weights of developer resulting from variations in the stirring speed of developer and in the toner concentration in developer, and it is thus possible to effectively suppress occurrence of image defects and deterioration of developer due to variations in the stirring speed and in the toner concentration. In particular, it has been confirmed that it is possible to notably suppress variations in the stable weights and stable volumes of developer resulting from variation in the stirring speed.

The present disclosure is applicable to a developing device that supplies two-component developer containing toner and carrier and that discharges surplus developer, and to an image forming apparatus provided with such a developing device. Based on the present disclosure, it is possible to provide a developing device that can reduce the width of variation in the stable developer amount inside the developer container resulting from variation in the transport speed of developer.

What is claimed is:

1. A developing device comprising:

a developer container in which two-component developer containing carrier and toner is stored, the developer container including;

a plurality of transport chambers arranged side by side, the plurality of transport chambers including a first transport chamber and a second transport chamber, a communication portion through which the first and second transport chambers communicate with each other in opposite end parts of the first and second transport chambers in a longitudinal direction thereof, a developer supply port through which developer is supplied into the developer container, and a developer discharge port which is arranged in a downstream-side end part of the second transport chamber in a transport direction of developer inside the second transport chamber and through which surplus developer in the developer container is discharged;

a first stirring/transporting member composed of a rotary shaft and a first transport blade formed on a circumferential surface of the rotary shaft, the first stirring/transporting member stirring and transporting developer inside the first transport chamber in an axial direction of the rotary shaft;

a second stirring/transporting member composed of a rotary shaft and a second transport blade formed on a circumferential surface of the rotary shaft, the second stirring/transporting member stirring and transporting the developer inside the second transport chamber in a direction opposite to the first stirring member;

a developer carrying member rotatably supported on the developer container, the developer carrying member carrying on a surface thereof the developer inside the second transport chamber;

a regulating portion formed next to, on a downstream side of, the second transport blade in the transport direction of the developer inside the second transport chamber, the regulating portion being formed by a transport blade that transports developer in a direction opposite to the second transport blade; and a disk formed apart from an upstream-side end part of the regulating portion at a position facing the communication portion on a downstream side of the second transport chamber, on an upstream side of the regulating portion in the transport direction of the developer inside the second transport chamber, the disk protruding in a radial direction over an entire circumference of the rotary shaft, wherein an outer diameter of the disk is larger than an outer diameter of the transport blade forming the regulating portion.

2. The developing device of claim 1, wherein the disk is formed between the second transport blade and the regulating portion.

3. The developing device of claim 1, wherein rotation speeds of the first and second stirring/transporting members are switchable in a plurality of steps.

4. An image forming apparatus comprising the developing device of claim 1.

5. A developing device comprising:

a developer container in which two-component developer containing carrier and toner is stored, the developer container including;

a plurality of transport chambers arranged side by side, the plurality of transport chambers including a first transport chamber and a second transport chamber, a communication portion through which the first and second transport chambers communicate with each other in opposite end parts of the first and second transport chambers in a longitudinal direction thereof, a developer supply port through which developer is supplied into the developer container, and a developer discharge port which is arranged in a downstream-side end part of the second transport chamber in a transport direction of developer inside the second transport chamber and through which surplus developer in the developer container is discharged;

a first stirring/transporting member composed of a rotary shaft and a first transport blade formed on a circumferential surface of the rotary shaft, the first stirring/transporting member stirring and transporting developer inside the first transport chamber in an axial direction of the rotary shaft;

a second stirring/transporting member composed of a rotary shaft and a second transport blade formed on a circumferential surface of the rotary shaft, the second stirring/transporting member stirring and transporting the developer inside the second transport chamber in a direction opposite to the first stirring member;

a developer carrying member rotatably supported on the developer container, the developer carrying member carrying on a surface thereof the developer inside the second transport chamber;

a regulating portion formed next to, on a downstream side of, the second transport blade in the transport direction of the developer inside the second transport chamber, the regulating portion being formed by a transport blade that transports developer in a direction opposite to the second transport blade; and a disk formed at a position facing the communication portion on a downstream side of the second transport chamber, on an upstream side of the regulating portion in the transport direction of the developer inside the second transport chamber, the disk protruding in a radial direction over an entire circumference of the rotary shaft, wherein the disk is formed to overlap the second transport blade.

6. The developing device of claim 5, wherein an outer diameter of the disk is equal to or larger than an outer diameter of the transport blade forming the regulating portion.

7. The developing device of claim 5, wherein rotation speeds of the first and second stirring/transporting members are switchable in a plurality of steps.

8. An image forming apparatus comprising the developing device of claim 5.

* * * * *